US005711518A

United States Patent [19]

Portaro et al.

[11] Patent Number: 5,711,518

[45] Date of Patent: Jan. 27, 1998

[54] BLANK FEED UNIT

[75] Inventors: Antonio Portaro, Milan; Fabio Sassi, Imola; Maurizio Andraghetti, Bologna, all of Italy

[73] Assignee: G.D Societa' per Azioni, Bologna, Italy

[21] Appl. No.: 458,512

[22] Filed: Jun. 2, 1995

[30] Foreign Application Priority Data

Jun. 7, 1994 [IT] Italy ..... BO94A0267

[51] Int. Cl.[6] ..... B65H 5/00

[52] U.S. Cl. ..... 271/10.03; 271/10.11; 271/121; 271/265.01; 271/188

[58] Field of Search ..... 271/10.02, 10.03, 271/10.05, 10.11, 150, 121, 125, 265.01, 122, 188

[56] References Cited

U.S. PATENT DOCUMENTS

| | | | |
|---|---|---|---|
| 4,316,606 | 2/1982 | Buys et al. . | |
| 4,437,658 | 3/1984 | Olson . | |
| 4,451,027 | 5/1984 | Alper . | |
| 4,515,358 | 5/1985 | Fukui . | |
| 4,586,705 | 5/1986 | Satoh et al. | 271/122 |
| 4,607,833 | 8/1986 | Svyatsky et al. | 271/10.11 |
| 4,858,905 | 8/1989 | Weigel | 271/10.11 |
| 5,129,641 | 7/1992 | Long | 271/10.03 |
| 5,190,277 | 3/1993 | Rahman | 271/121 |
| 5,192,069 | 3/1993 | Seymour et al. | 271/121 |

FOREIGN PATENT DOCUMENTS

| | | | |
|---|---|---|---|
| 0045364 | 2/1982 | European Pat. Off. . | |
| 0390389 | 10/1990 | European Pat. Off. . | |
| 62-105834 | 5/1987 | Japan | 271/10.11 |
| 2258221 | 2/1993 | United Kingdom . | |

*Primary Examiner*—H. Grant Skaggs
*Attorney, Agent, or Firm*—Klauber & Jackson

[57] ABSTRACT

A blank feed unit wherein a store housing a stack of blanks presents, at the bottom end, an outlet from which the blanks are withdrawn successively in a given direction and along a given path by an extracting assembly presenting a conveyor roller located at the outlet of the store, contacting the bottom end of the stack, and tangent to the path, and a brake element located at the outlet and on the opposite side of the path in relation to the conveyor roller the.

10 Claims, 3 Drawing Sheets

BLANK FEED UNIT

BACKGROUND OF THE INVENTION

The present invention relates to a blank feed unit.

More specifically, the present invention relates to a unit for feeding blanks from a store in which they are housed in a stack.

The present invention is especially advantageous for use in the tobacco industry, in particular for feeding blanks to a wrapping machine such as a cigarette packing or cartoning machine, to which the following description refers purely by way of example.

SUMMARY OF THE INVENTION

It is an object of the present invention to provide a feed unit of the aforementioned type, which, in addition to being particularly economical, also operates reliably at relatively high speeds and provides for feeding the blanks continuously and in equally spaced manner.

According to the present invention, there is provided a blank feed unit comprising a store for housing a stack of blanks and presenting an outlet; and a feed assembly for successively extracting the blanks from said outlet and feeding them in a given direction and along a given path; characterized in that the feed assembly comprises an extracting assembly in turn comprising a conveyor roller substantially tangent to said path and to the store at said outlet; and braking means on the opposite side of said path in relation to said conveyor roller and substantially tangent to the path.

The friction coefficient between the braking means of the above unit and the blanks is preferably greater than that between two said blanks, and less than that between the periphery of the conveyor roller and the blanks.

According to a preferred embodiment of the above unit, the braking means comprise a pressure roller at said outlet; drive means being provided to rotate the conveyor roller and the pressure roller in opposite directions, and so that the surface speed of the conveyor roller is greater than that of the pressure roller.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
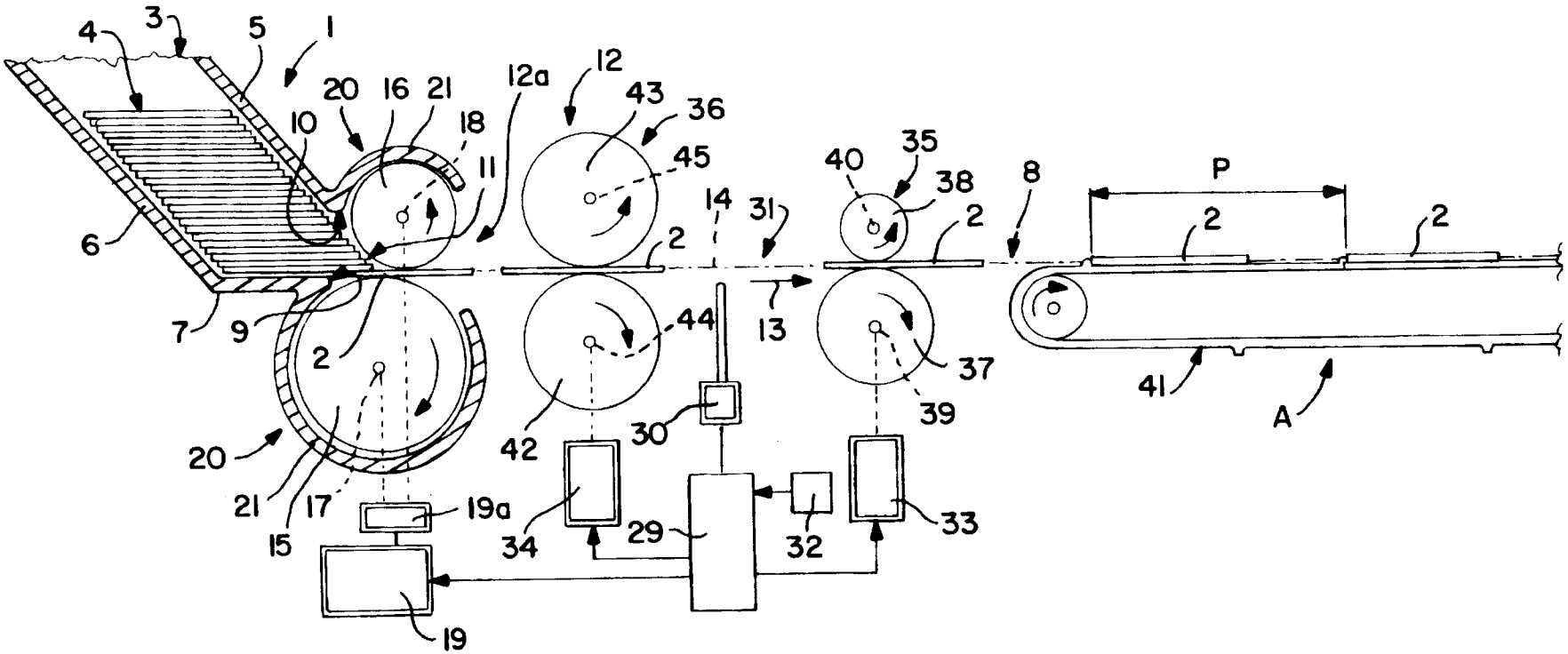
FIG. 1 shows a partially sectioned schematic side view of a first preferred embodiment of the feed unit according to the present invention.

Number 1 in FIG. 1 indicates a feed unit for successively feeding blanks 2 to a wrapping machine A, and comprising a store 3 for housing a stack 4 of blanks 2. In the FIG. 1 embodiment, store 3 presents a front wall 5 and a rear wall 6 parallel to each other and inclined at an angle of less than 90° to the vertical, and is closed at the bottom by a substantially horizontal wall 7, the upper surface of which is coplanar with the plane 8 along which blanks 2 are fed on leaving store 3. Wall 7 extends along a rear portion (in the traveling direction of blanks 2 along plane 8) of the bottom end of store 3, and the front edge 9 of wall 7 defines, with the bottom edge 10 of wall 5, an outlet 11 from which blanks 2 are withdrawn from store 3. More specifically, edge 10 is located a given distance from plane 8, so that outlet 11 extends partly along plane 8 and partly along the plane of wall 5.

In addition to store 3, unit 1 also comprises a feed assembly 12 facing outlet 11 and which provides for successively sliding blanks 2 off the bottom end of stack 4 and feeding them with a given spacing P and in direction 13 along a path 14 coplanar with plane 8.

Assembly 12 comprises an extracting assembly 12*a* defined by two counter-rotating rollers 15 and 16 located on either side of path 14 and rotated about respective axes 17 and 18 parallel to plane 8 and perpendicular to direction 13 by a motor 19 connected to rollers 15 and 16 via a transmission 19*a*. More specifically, roller 15 is a conveyor roller with its periphery tangent to plane 8 at outlet 11, and transmission 19*a* is so formed as to rotate roller 15 at a surface speed V1 directed in direction 13 at outlet 11 and greater than the surface speed V2 imparted by transmission 19a to roller 16 which provides for braking blanks 2. Roller 16, which is a pressure roller located over roller 15 at outlet 11 and substantially tangent to the inner surface of wall 5, may even be stationary, and, in a variation not shown, may be replaced by a straightforward pad pushed elastically against the periphery of roller 15. Rollers 15 and 16 are housed inside casings 20 defined by two curved walls 21 partially surrounding the outer periphery of rollers 15 and 16 and connected to walls 7 and 5 along edges 9 and 10.

Rollers 15 and 16 are made of such a material and/or their outer peripheries are so formed that the friction coefficient between the outer periphery of roller 16 and blanks 2 is less than that between the outer periphery of roller 15 and blanks 2, and greater than that between two mutually contacting blanks 2.

Figure 2A:
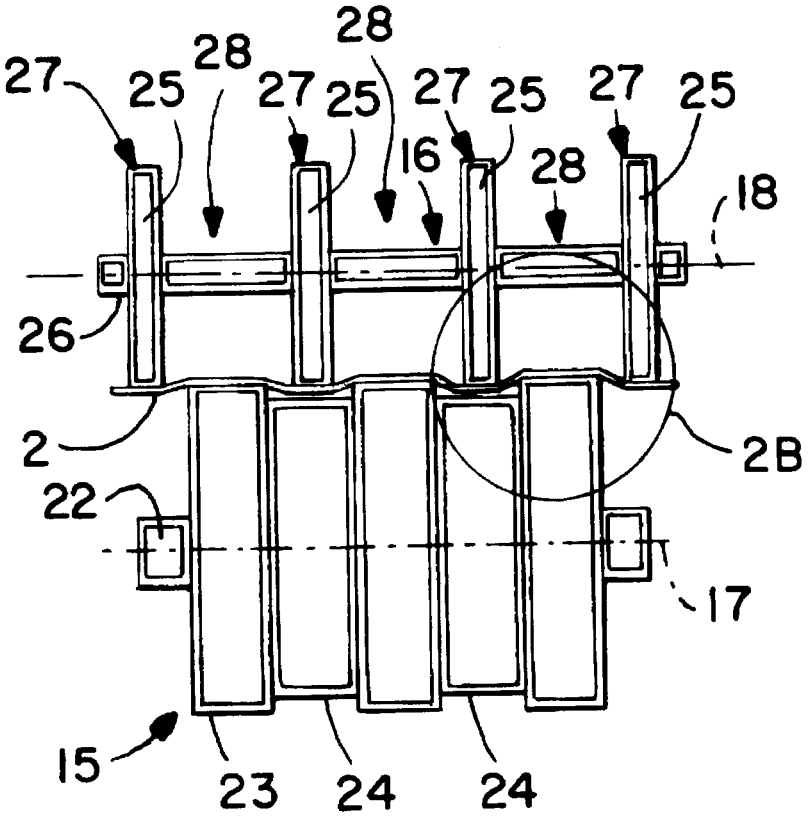
FIG. 2 is a front view showing a larger-scale detail of FIG. 1.
Figure 2B:
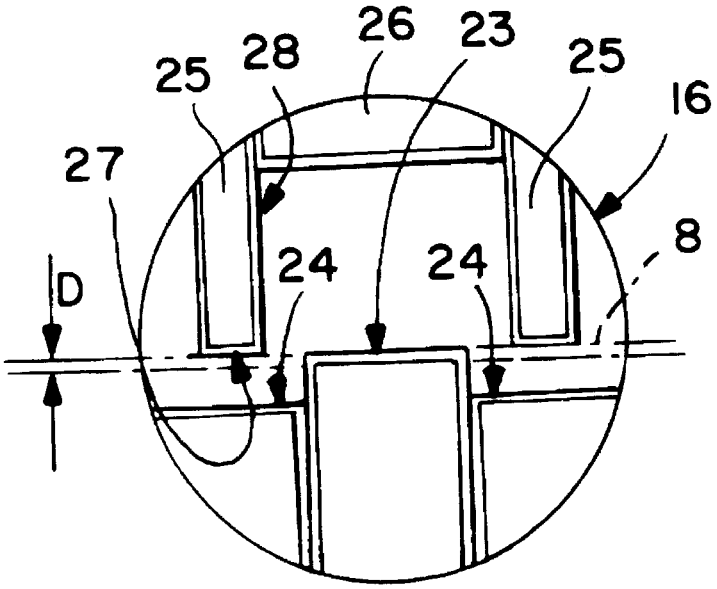

According to the preferred embodiment shown in FIG. 2, roller 15 is fitted to a central shaft 22 coaxial with axis 17, and is defined externally by a cylindrical surface 23 coaxial with axis 17 and presenting a number of annular grooves 24 equally spaced along axis 17; and roller 16 is defined by a number of disks 25 fitted to a central shaft 26 coaxial with axis 18, and substantially equally spaced along axis 18 with the same spacing as grooves 24 along axis 17. As shown in FIG. 2, surface 23 is tangent to plane 8, whereas each disk 25 is defined externally by a cylindrical surface 27, the radius of which is normally greater than the distance between plane 8 and axis 18 minus the thickness of blanks 2, and, in the case of relatively thin blanks 2, may even be greater by distance D than the distance between plane 8 and axis 18.

Each pair of adjacent disks 25 define an annular groove 28 coaxial with axis 18 and offset in relation to two corresponding adjacent grooves 24; and, in the FIG. 1 arrangement, the outer periphery of each disk 25 extends through path 14, and at least some of disks 25 partially engage respective grooves 24.

As shown in FIG. 1, assembly 12 comprises a central control unit 29, a first input of which is supplied with a position signal emitted by a sensor 30 and indicating the passage of the front edge of each blank 2 through a detecting station 31, and a second input of which is supplied with a timing signal emitted by a reference emitter 32 and indicating the operating phase of wrapping machine A to which the blanks 2 withdrawn from store 3 are supplied. Control unit 29 provides for speed controlling both motor 19 and a further two motors 33 and 34 for respectively operating a timing assembly 35, and a negative feedback assembly 36 located along path 14 between station 31 and outlet 11.

Timing assembly 35 forms part of feed assembly 12, and comprises two substantially cylindrical rollers 37 and 38 located on either side of path 14, tangent to each other and to plane 8, and rotating in opposite directions about respective axes 39 and 40 parallel to axes 17 and 18. Roller 38 is an idle roller, whereas roller 37 is connected to motor 33 which is so controlled by unit 29 as to eliminate, for each blank 2, any phase difference between the position and timing signals, and so feed blanks 2 with said spacing P to the input conveyor 41 of wrapping machine A.

Negative feedback assembly 36 also forms part of assembly 12, and comprises both extracting assembly 12*a* and a further two substantially cylindrical rollers 42 and 43 located on either side of path 14, tangent to each other and to plane 8, and rotating in opposite directions about respective axes 44 and 45 parallel to axes 17 and 18. Roller 43 is an idle roller, whereas roller 42 is rotated at a surface speed V3 greater than speed V1 of conveyor roller 15 by motor 34 which, together with motor 19, is so controlled by unit 29 as to maintain a substantially constant ratio between speeds V3 and V1.

Operation of unit 1 will now be described relative to the supply of two successive blanks 2, the front portion of the first of which contacts surface 23 of roller 15 when stack 4 is inserted inside store 3.

As of the above condition, when motor 19 is operated at a given constant speed, conveyor roller 15 is rotated so as to slide the bottom portion of stack 4 partially and differentially towards outlet 11.

The greater friction between blanks 2 and roller 15 as compared with that between blanks 2 and roller 16 enables the first blank 2 to be withdrawn from the bottom of the stack and fed at speed V1 in direction 13 and along path 14 to rollers 42 and 43 of assembly 36. Roller 16, by rotating at a slower surface speed V2 as compared with V1, not only acts as a brake for the blanks 2 on top of the first, but in general also allows at least one of the superimposed blanks 2 to be inserted partially between rollers 15 and 16 and on top of the first blank 2, so as to further reduce the friction (in this case, between two mutually contacting blanks 2) hindering withdrawal of the first blank 2.

Upon passage of the front edge of the first blank 2 through station 31, sensor 30 emits a position signal which is received by central control unit 29 together with, but not necessarily at the same time as, a timing signal emitted by emitter 32 and indicating the correct instant in which the front edge should have passed through station 31 for blank 2 to reach conveyor 41—and hence machine A—in time with machine A.

At this point, control unit 29 compares the emission times of the two position and timing signals and, if any phase difference exists, emits a phase displacement signal to accelerate or decelerate motor 33 in known manner, so as to rotate roller 37 at such a surface speed V4—normally greater than V1—as to eliminate the phase difference before the front edge of blank 2 reaches conveyor 41.

At the same time, by means of said phase displacement signal, control unit 29 accelerates or decelerates motor 34 and hence motor 19 to eliminate from the outset any phase difference of the next blank 2.

Assembly 36 therefore provides, in steady operating mode, for substantially eliminating correction by control unit 29.

Figure 3:
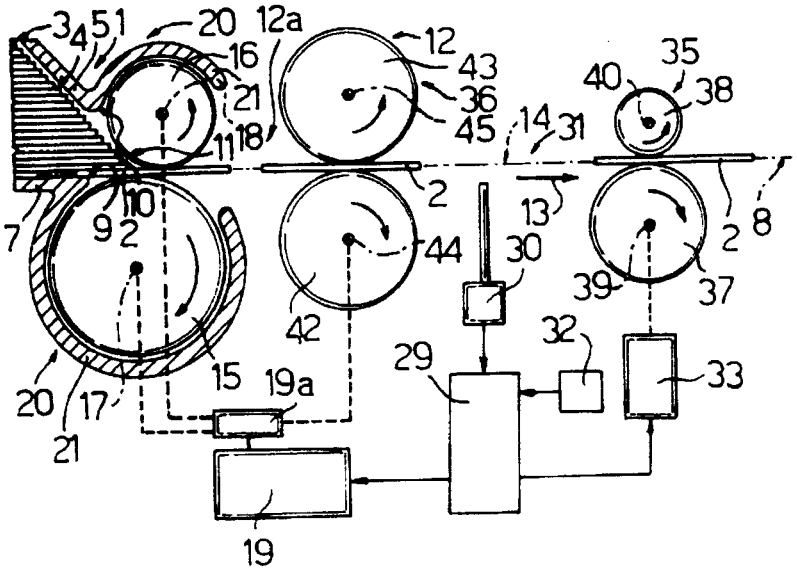
FIGS. 3, 4 and 5 show partially sectioned schematic side views of a further three preferred embodiments of the feed unit according to the present invention.

In the FIG. 3 embodiment, roller 42 of assembly 36 is connected by transmission 19*a* to motor 19 of extracting assembly 12*a*, so that unit 29 provides for speed controlling motor 19 so that the withdrawn blank 2 is fed at such a speed V3 as to reach station 31 perfectly in time with the emission of the timing signal by emitter 32, and at the same time for speed controlling motor 33 so that roller 37 is rotated at such a surface speed V4 as to eliminate the phase differences before the front edge of blank 2 reaches conveyor 41.

Figure 4:
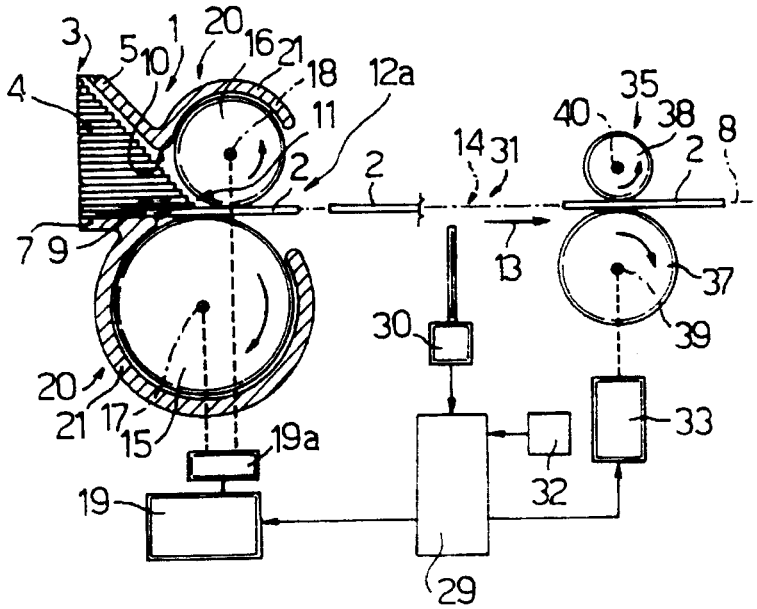

In the further embodiment shown in FIG. 4, assembly 12 only comprises extracting assembly 12*a*, the rollers 15 and 16 of which are operated by motor 19 which is speed controlled by control unit 29 together with motor 33 of timing assembly 35.

Figure 5:
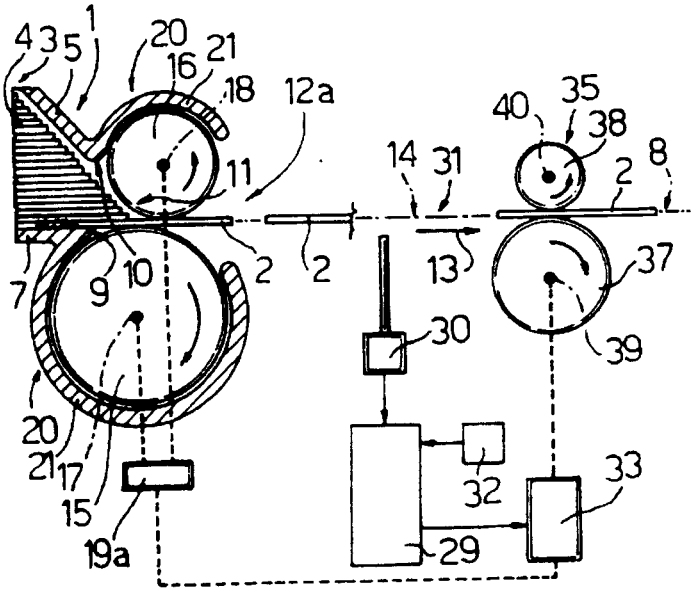

FIG. 5 shows a variation of the FIG. 4 embodiment, wherein rollers 15 and 16 of extracting assembly 12*a* are rotated, via transmission 19*a*, by motor 33 which also operates roller 37 of timing assembly 35, so that the ratio between speeds V1 and V4 remains constant.

We claim:

1. A blank feed unit comprising:

a store (3) for housing a stack (4) of blanks (2) and having an outlet (11); an a feed assembly (12) for successively extracting the blanks (2) from said outlet (11) and feeding said blanks (2) in a given direction (13) and along a given path (14); the feed assembly (12) including an extracting assembly (12*a*), the extracting assembly including a conveyor roller (15) substantially tangent to said path (14) and to the store (3) at said outlet (11 ); and braking means (16) on the opposite side of said path (14) in relation to said conveyor roller (15) and substantially tangent to the path, said braking means including a pressure roller (16) at said outlet (11 ) and drive means (19) for rotating said conveyor roller (15) and said pressure roller (16) in opposite directions, wherein the conveyor roller (15) has a surface speed greater than that of the pressure roller (16).

2. A unit as claimed in claim 1, wherein the friction coefficient between said braking means (16) and said blanks (2) is greater than that between two said blanks (2) and less than that between the periphery of said conveyor roller (15) and the blanks (2).

3. A unit as claimed in claim 1, wherein said conveyor and pressure rollers (15, 16) respectively have a first and second number of peripheral annular grooves (24,28) offset in relation to each other and substantially complementary.

4. A unit as claimed in claim 3, wherein the outer periphery of said pressure roller (16) interferes with said path (14).

5. A unit as claimed in claim 1, wherein said feed assembly (12) further comprises:

detecting means (30) for emitting a timing signal for each blank (2) as said blank passes through a detecting station (31) located along said path (14) and downstream from the extracting assembly (12*a*) in the traveling direction (13) of the blanks (2) along said path (14);

emitting means (32) for emitting a reference signal for each blank (2);

comparing means (29) for comparing said two signals and emitting a phase displacement signal for each blank (2); and timing means (35) for adjusting the traveling speed of each blank (2) along said path (14) in response to the respective said phase displacement signal.

6. A unit as claimed in claim 5, wherein said timing means (35) are located along said path (14) and comprise a third and fourth counter-rotating roller (37, 38) on either side of said path (14) and cooperating with opposite surfaces of said blank (2); said third roller (37) being a powered roller speed controlled by said comparing means (29).

7. A unit as claimed in claim 5, wherein said supply assembly (12) also comprises negative feedback means (36; 12*a*, 36; 12*a*) for successfully engaging and successfully feeding said blanks (2) along said path (14); said negative feedback means (36; 12*a*, 36; 12*a*) being controlled by said comparing means (29).

8. A unit as claimed in claim 7, wherein said negative feedback means (36, 12*a*; 12*a*) are located along said path (14), upstream from said detecting station (31), and comprise said extracting assembly (12*a*).

9. A unit as claimed in claim 7, wherein said negative feedback means (36; 12*a*, 36) comprise a fifth and sixth counter-rotating roller (42, 43) on either side of said path (14) and cooperating with opposite surfaces of each said blank (2); said fifth roller (42) being a powered roller speed controlled by said comparing means (29).

10. A blank feed unit comprising;

a store (3) for housing a stack (4) of blanks (2) and having an outlet (11);

a feed assembly (12) for successively extracting the blanks (2) from said outlet (11) and feeding said blanks (2) in a given direction (13) and along a given path (14), the feed assembly (12) including:

an extracting assembly (12*a*) comprising a conveyor roller (15) substantially tangent to said path (14) and to the store (3) at said outlet (11); and motorized braking means (16) on the opposite side of said path (14) in relation to said conveyor roller (15) and substantially tangent to the path (14) and the conveyor roller (15), wherein said braking means comprise a motorized pressure roller (16) at said outlet (11); and drive means (19) for rotating said conveyor roller (15) and said pressure roller (16) in opposite directions, wherein the conveyor roller (15) has a surface speed greater than that of the pressure roller (16).

* * * * *